US008733061B1

(12) United States Patent
McDonald

(10) Patent No.: US 8,733,061 B1
(45) Date of Patent: May 27, 2014

(54) TRUSS BRACKET FOR STUDLESS WALL SYSTEM

(75) Inventor: William D McDonald, Santa Rosa, CA (US)

(73) Assignee: Bamcore LLC, Santa Rosa, CA (US)

( * ) Notice: Subject to any disclaimer, the term of this patent is extended or adjusted under 35 U.S.C. 154(b) by 0 days.

(21) Appl. No.: 13/454,909

(22) Filed: Apr. 24, 2012

Related U.S. Application Data

(63) Continuation-in-part of application No. 12/147,444, filed on Jun. 26, 2008, now Pat. No. 8,161,697.

(60) Provisional application No. 60/946,705, filed on Jun. 27, 2007.

(51) Int. Cl.
*E04B 1/38* (2006.01)
*E04B 7/04* (2006.01)

(52) U.S. Cl.
USPC ..... 52/715; 52/586.1; 52/92.2; 52/93.2; 52/300

(58) Field of Classification Search
USPC ..... 52/712–715, 586.1, 586.2, 665, 92.1, 52/92.2, 93.1, 93.2, 783.1, 300
See application file for complete search history.

(56) References Cited

U.S. PATENT DOCUMENTS 2,078,491 A * 4/1937 Graham ..... 52/241
3,256,030 A * 6/1966 Banse ..... 403/400
3,967,908 A * 7/1976 Snow et al. ..... 403/219
4,052,828 A * 10/1977 Mancini et al. ..... 52/242
4,625,415 A * 12/1986 Diamontis ..... 33/613
4,897,976 A * 2/1990 Williams et al. ..... 52/281
4,932,173 A * 6/1990 Commins ..... 52/92.2
5,109,646 A * 5/1992 Colonias et al. ..... 52/712
5,335,469 A * 8/1994 Stuart ..... 52/655.1
5,481,844 A * 1/1996 Kajita ..... 52/702
5,904,023 A * 5/1999 diGirolamo et al. ..... 52/712
6,298,619 B1 * 10/2001 Davie ..... 52/293.3
D467,007 S * 12/2002 Daudet et al. ..... D25/61
6,655,096 B1 * 12/2003 Pryor ..... 52/92.2
6,837,019 B2 * 1/2005 Collie ..... 52/712
6,931,813 B2 * 8/2005 Collie ..... 52/713
7,216,465 B2 * 5/2007 Saldana ..... 52/655.1
7,310,914 B1 * 12/2007 Moore ..... 52/92.2
7,316,098 B1 * 1/2008 Sackett ..... 52/92.2
D576,472 S * 9/2008 Gaiardo ..... D8/354
7,971,410 B2 * 7/2011 Jerke ..... 52/702
8,161,697 B1 * 4/2012 McDonald ..... 52/241
8,307,583 B2 * 11/2012 Keys et al. ..... 52/92.2
8,607,532 B2 * 12/2013 Permesang ..... 52/796.1
2007/0209311 A1 * 9/2007 Keys ..... 52/696
2009/0178362 A1 * 7/2009 Jerke ..... 52/656.9

* cited by examiner

*Primary Examiner* — Robert Canfield
*Assistant Examiner* — Brent W Herring
(74) *Attorney, Agent, or Firm* — Gary Hoenig

(57) ABSTRACT

A truss bracket for mounting roof trusses and floor joists to wall systems absent traditional wood frame top plates utilizing in-plane end load bearing panels, resembling a chair, comprises a base plate with a vertical receiving plate extending upwards from the rear of the base plate for receiving a typical roof truss or floor joist and having downwardly extending mounting tabs along the left and right sides of the base plate suitable for being received by grooves in top track grooves of an in-plane end load bearing panel wall system or for attachment to the vertical sides of panels of a wall. The truss bracket provides high uplift load capacity by arranging all fasteners to the wall system and the truss or joint in shear when loaded.

11 Claims, 5 Drawing Sheets

FIG.5
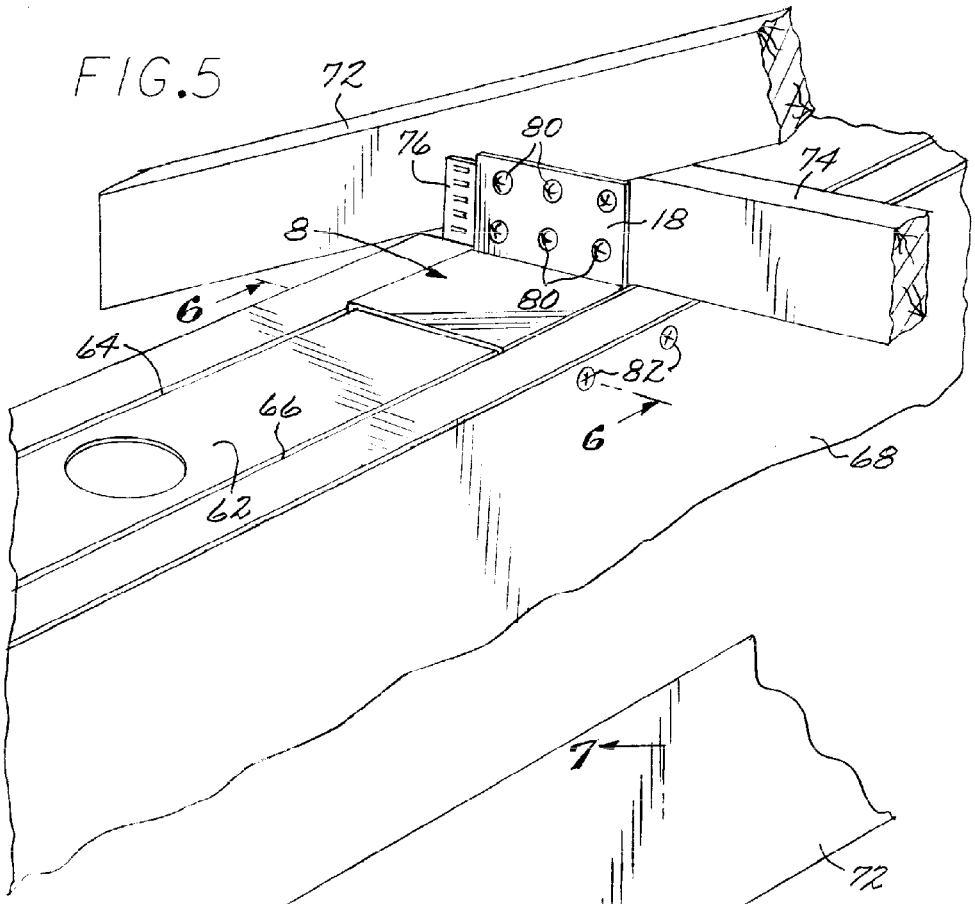
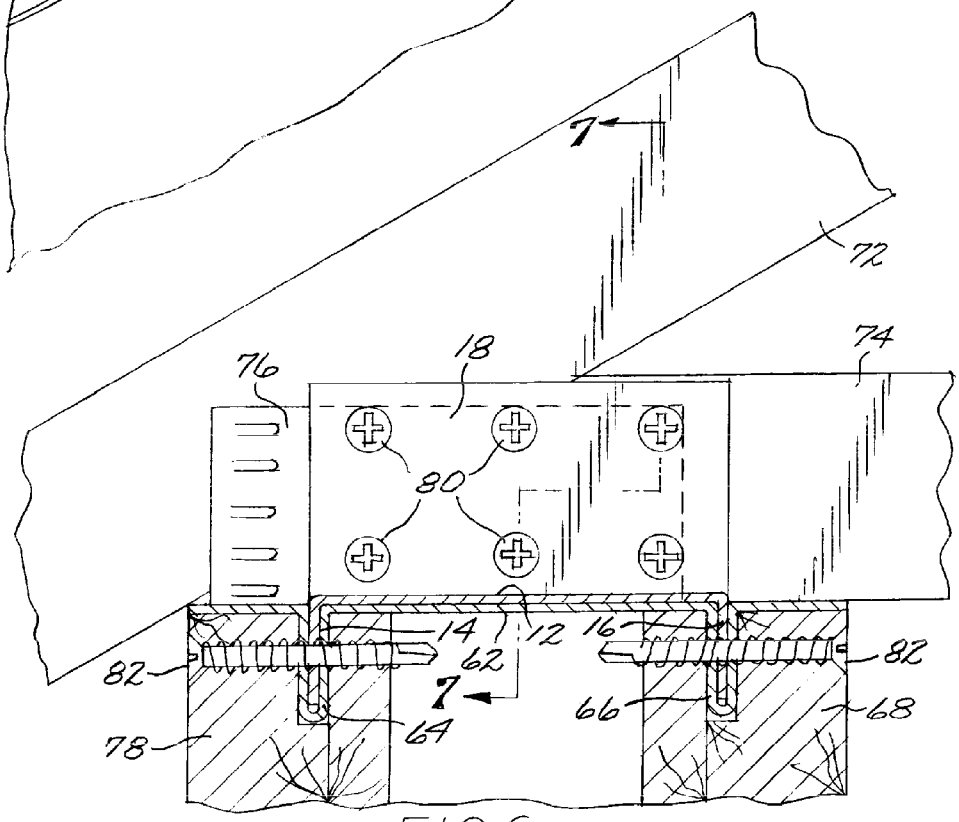
FIG.6

TRUSS BRACKET FOR STUDLESS WALL SYSTEM

RELATED APPLICATIONS

This non-provisional patent application, filed in the United States Patent and Trademark Office, is a Continuation-In-Part of U.S. patent application Ser. No. 12/147,444, filed Jun. 26, 2008, from which priority is claimed and whose disclosure is hereby incorporated by reference in its entirety.

FIELD OF THE INVENTION

The invention relates to the construction industry and building materials; and, more particularly to a truss bracket apparatus for mounting roof trusses, floor joists and similar construction components to wall systems.

BACKGROUND OF THE INVENTION

Traditional western construction practices for wood based home building are typically directed towards assembling a frame, formed from studs, upon which sheeting is installed in the form of plywood for outside surfaces and drywall for inside wall surfaces. The frame is first constructed by carpenters in a piecemeal fashion wherein the various members are cut and fastened into position. With the frame in place, sheeting is applied to form the wall surfaces. The frame provides the strength of the structure as the vertical stud members assume the load of the constructed walls. The top member of a wood frame, the top plate, is typically a horizontally disposed lumber section nailed to the vertical studs. Roof trusses rest on the top plate and are typically toe nailed to the top plate or an L-shaped clip is nailed into the top surface of the top plate and then nailed into a side surface of the roof truss. The attachment of the roof trusses to the top plate must have sufficient integrity to withstand uplift forces caused by wind load under the overhang of the roof. High uplift loads can pull the clip nails out of the top plate or dislodge the toe nailing. Also, the top plate is typically nailed to the studs, consequently uplift forces may also dislodge these fasteners by pulling the nails from the studs.

Wall systems comprising high in-plane end load bearing panels, such as disclosed by McDonald in U.S. Ser. No. 12/147,444, form hollow walls without studs or wood frame. These systems are often absent the wood frame top plate and therefore do not provide a nailing surface along the top of the wall for mounting clips or toe nailed roof trusses. These wall systems do not require a top plate as the panels forming the interior and exterior portions of the wall bear the load along the top end of the panel. The panels are secured in position by top and bottom sheet metal tracks to maintain the spacing between the panels and therefore no nailing surface is available along the top surface of a wall section. Similar challenges present themselves between stories when incorporating rim and floor joists.

There are a number of disadvantages exhibited when using toe nailing or L-shaped clips (L-clips) as indicated particularly when there is no top plate component suitable for receiving nails. In order to maximize the strength of a roof truss or floor joist mounting system, ideally the fasteners between the various elements should be in shear when load is applied. Toe nailing and L-clip arrangements all commonly include fasteners that are under tension under load thereby significantly reducing the strength of the connection that is critical under high wind uplift loads. In tension, nail type fasteners positioned vertically into the top surface of a top plate loose strength as the nails can be pulled out of the plate. Using an L-clip, fasteners fixing the clip to the truss are in shear under load, an ideal configuration; however, the fastening to the top plate is in tension. Toe nailing fasteners are primarily in tension under load.

Therefore, what is needed is an apparatus to secure roof trusses and floor joists to wall systems absent top plate nailing surfaces and to provide a means for connecting a roof truss or floor joist to a wall system wherein all fasteners are in shear.

SUMMARY OF THE INVENTION

Accordingly, the present invention is directed to construction techniques utilizing in-plane end load bearing panels for studless hollow wall systems, and, more specifically, to a truss bracket apparatus facilitating attachment of roof truss and floor joists to wall systems absent top plate nailing surfaces providing high load capacity, speedy assembly, and low material and manufacturing costs, thereby substantially obviating one or more of the problems due to the limitations and disadvantages of the related art.

The mounting mechanism provided is a truss bracket apparatus comprising a base plate, being a flat rectangular plate having a width, a length, and rear, left and right edges, a left mounting tab, being a flat rectangular plate having a top edge fixed to the left edge and along the length of the base plate and extending downwards from base plate, a right mounting tab, being a flat rectangular plate having a top edge fixed to the right edge and along the length of the base plate and extending downwards from the base plate and extending upwards; and a vertical receiving plate, being a flat plate having a bottom edge fixed to the rear edge of the base plate and extending upwards. The assembly resembles a chair form. A hollow wall system top track having at least two longitudinally arranged ribs fashioned in the track form longitudinal grooves in the top side of the top track for receiving the left and right mounting tabs of the truss bracket. The ribs protruding from the bottom of the top track are received by longitudinal grooves in the top edge of the in-plane end load bearing panels of the wall system. Fasteners are driven perpendicularly from the vertical side of the end load bearing panels, through the panel, into the groove in the top, into the rib of the top track, through the mounting tab of the truss bracket, through the opposing side of the rib of the top track, and into the opposing side of the groove and then into the opposing panel material. The fasteners fix the top track to the wall panels and also the truss bracket to the top track. A roof truss or floor joist is attached to the vertical receiving plate by fasteners positioned through bores in the vertical receiving plate and into the truss or joist; however, the vertical receiving plate may be used for attachment of other structural components as required. It will be appreciated that all fasteners are arranged such that uplift loads place the fasteners in shear, not tension, so as to substantially improve the strength of the connection as compared to prior art solutions.

It will further be appreciated that the truss bracket according to the present invention does not require the use of the top track of a wall system. For example, the truss bracket may be mounted on a convention wood frame top plate with the mounting tabs flush with the vertical sides of the top plate. Fasteners through the mounting tabs fixing the truss bracket to the vertical sides of the top plate will also be in tension in uplift load conditions thereby providing a substantial improvement in strength over L-clips and toe nailing.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

In the drawings:

FIG. 5 is a perspective view of the truss bracket of FIG. 1 mounted within the channels of a top track of a studless hollow in-plane end load bearing panel wall system and fastened to and receiving a typical wood roof truss assembly.

FIG. 6 is a cross section view of the truss bracket of FIG. 1, wall system and typical roof truss of FIG. 5 taken along Line 6-6 of FIG. 5 securing the typical roof truss received by the channels of the top track of a studless hollow in-plane end load bearing panel wall system showing details of the wall and track means for fastening to the wall system.

DETAILED DESCRIPTION OF THE INVENTION

Although particular embodiments of the invention have been described in detail for purposes of illustration, various modifications may be made without departing from the spirit and scope of the invention. Where examples are presented to illustrate aspects of the invention, these should not be taken as limiting the invention in any respect.

Figure 1:
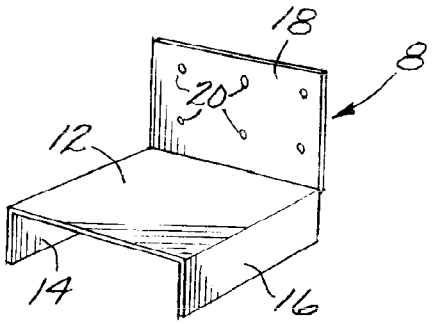
FIG. 1 is a perspective view of the truss bracket for studless hollow in-plane end load bearing panel walls according to the present invention.

Now referring in greater detail to the various figures of the drawings wherein like reference characters refer to like parts, there is shown in FIG. 1, is a first embodiment of the present invention, a truss bracket, shown at 8, suitable for fixing a typical roof truss to the top of a wall section. The truss bracket 8 comprises a rectangular base plate 12 having a width and rear, left and right edges, a left mounting tab 14 being a plate having a top edge fixed to the left edge of the base plate 12 and extending downwards, a right mounting tab 16 being a plate having a top edge fixed to the right edge of the base plate 12 and extending downwards, and a vertical receiving plate 18 having a bottom edge fixed to the rear edge of base plate 12 and extending upwards. A side surface of a typical roof truss is disposed adjacent to the vertical receiving plate 18 and fixed to the bracket 8 by means for fastening the bracket to the truss. The vertical receiving 18 plate has a width the same as the base plate 12 facilitating the attachment of roof trusses. Vertical receiving plate bores 20 for fasteners are provided to insure that a sufficient number of fasteners are installed so as to achieve a structurally sound assembly.

Figure 2:
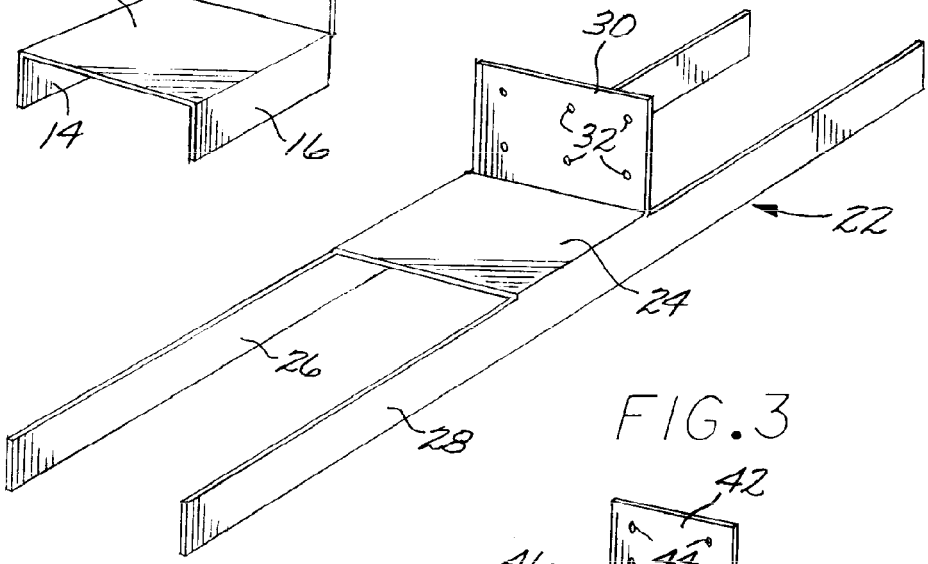
FIG. 2 is a perspective view of a first alternate embodiment of the truss bracket according to the present invention illustrating the forward and rearward extending mounting tab extensions.

Referring to FIG. 2 wherein a second embodiment 22 of the truss bracket is illustrated, the downward extending left 26 and right 28 mounting tabs, similarly attached at the top edges to the base plate 24, each have extensions to the front and rear of the bracket 22 thereby providing additional surface contact with a wall structure. The vertical receiving plate 30 fixed to the rear of the base plate 24 has a width the same as the base plate 24 also making the second embodiment 22 best suited for roof truss attachment applications wherein the roof truss is fixed with a means for fastening the bracket through vertical receiving plate bores 32.

Figure 3:
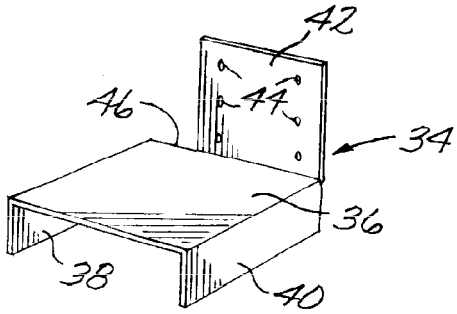
FIG. 3 is a perspective view of a second alternate embodiment of the truss bracket illustrating the vertically disposed receiving plate having a relief portion removed to facilitate attachment of a typical wood rim joist.

A third embodiment 34 of the truss bracket according to the present invention is illustrated in FIG. 3 having the same base plate 36 and left 38 and right 40 mounting tabs, and having vertical receiving plate 42 similarly fixed to the rear edge of the base plate 36 wherein the width of the vertical receiving plate 42 is reduced to accommodate a wood frame rim joist. The rim joist relief 46 provides clearance for a rim joist mounted longitudinally along the left side of the base plate 36 and flush with the top surface of the base plate 36. A floor joist may then be fixed to the vertical receiving plate 42 with a means for fastening the bracket through vertical receiving plate bores 44.

Figure 4:
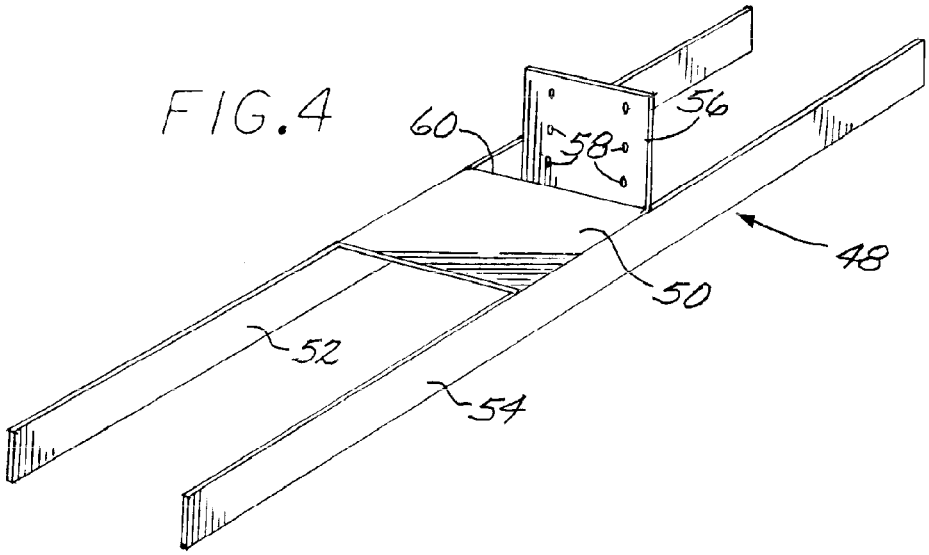
FIG. 4 is a perspective view of a third alternate embodiment of the truss bracket similar to FIG. 3 illustrating the forward and rearward extensions of the mounting tab portions of the second embodiment of FIG. 2.

Referring now to FIG. 4, a fourth embodiment 48 of the truss bracket is illustrate being similar to the third embodiment 34 having forward and rear extensions to the left 52 and right 54 mounting tabs downwardly disposed from the left and right edges of base plate 50. A similar rim joist relief 60 provides access for a rim joist and narrowing the width of the vertical receiving plate 56 comprising vertical receiving plate bores 58 for a means of fastening a floor joist to the plate.

Figure 7:
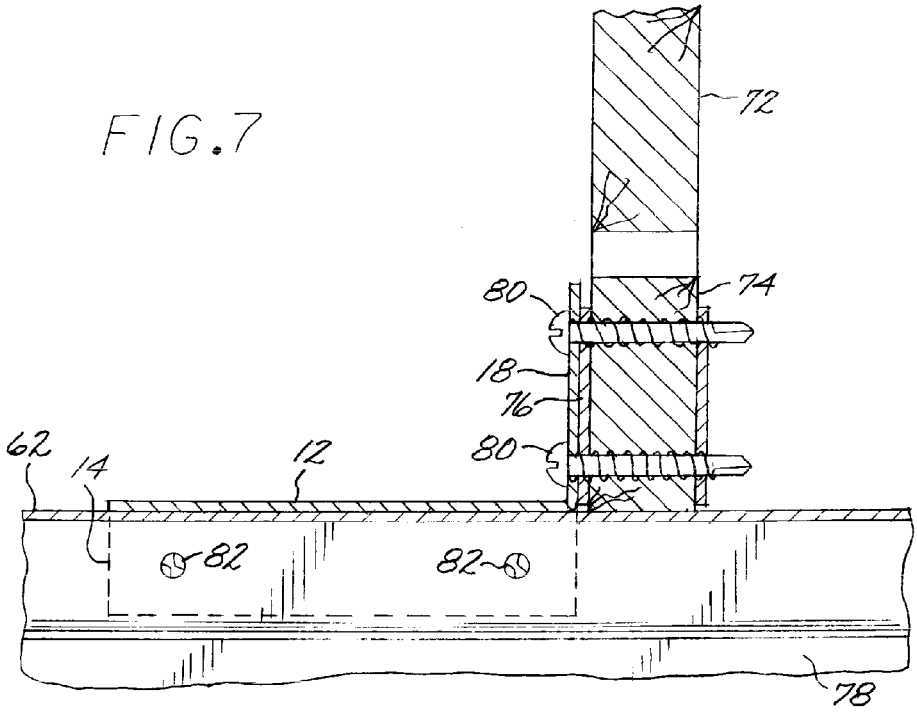
FIG. 7 is a cross section of the truss bracket, wall and truss of FIG. 6 taken along Line 7-7 of FIG. 6 wherein the roof truss means of fastening the truss bracket to a chords and gang plate of a typical roof truss.

A typical roof truss mount assembly utilizing the truss bracket according to the present invention is shown in FIGS. 5, 6 and 7. A top track 62 of a in-plane end load bearing panel studless hollow wall system is shown in position longitudinally mounted along the top of a wall section and, being an elongate plate, having left 64 and right 66 grooves forming downward facing ribs in the track 62 positioned within longitudinal grooves with the top end of the panels 68. The truss bracket 8 is positioned in the top track 62 with the left and right mounting tabs respectively in grooves 64 and 66. A typical roof truss is illustrated having a bottom chord 74 positioned perpendicularly across the top of the wall section and flush with truss bracket 8 vertical receiving plate 18. The top chord 72 of the roof truss is typically fixed to the bottom chord 74 by a gang plate 76 whose position is not critical with respect to the truss bracket 8. The vertical receiving plate 18 is fixed by fasteners 80 to the roof truss.

Details of the attachment to the wall section are illustrated in the cross section view provided in FIG. 6. The top track 62 secures the right panel 68 to the left panel 78 providing a predetermined wall cavity spacing. The grooves left 64 and right 66 of the top track 62 form ribs and are shown in position within grooves in the top end of the panels 78, 68. The base plate 12 is mounted flush with the top track 62 and with the left 14 and right 16 mounting tabs positioned within the top track grooves 64 and 66. Fasteners 82 are disposed through the panels 78 and 68, the top track grooves 64 and 66 and the mounting tabs 14 and 16. Uplift forces on the truss bracket necessarily load fasteners 82 in shear thereby providing outstanding load capacity and secure attachment to the wall panels 78 and 68. Fasteners 82 are preferably screws having a drill point as fasteners bores are not present in the mounting tabs 14 and 16; however, any suitable means for fastening may be used including self-tapping screws, screws, brads, nails and bolts.

A further cross section view of the truss bracket assembly taken longitudinally along a wall section, as in FIG. 7, shows details of the attachment of a typical roof truss to the vertical receiving plate 18 wherein fasteners penetrate the gang plate 76 securing the bottom chord 74 to the bracket. A portion of the top chord 72 may also be engaged by fasteners 80 depending upon the positioning of the roof truss on the wall section.

Figure 8:
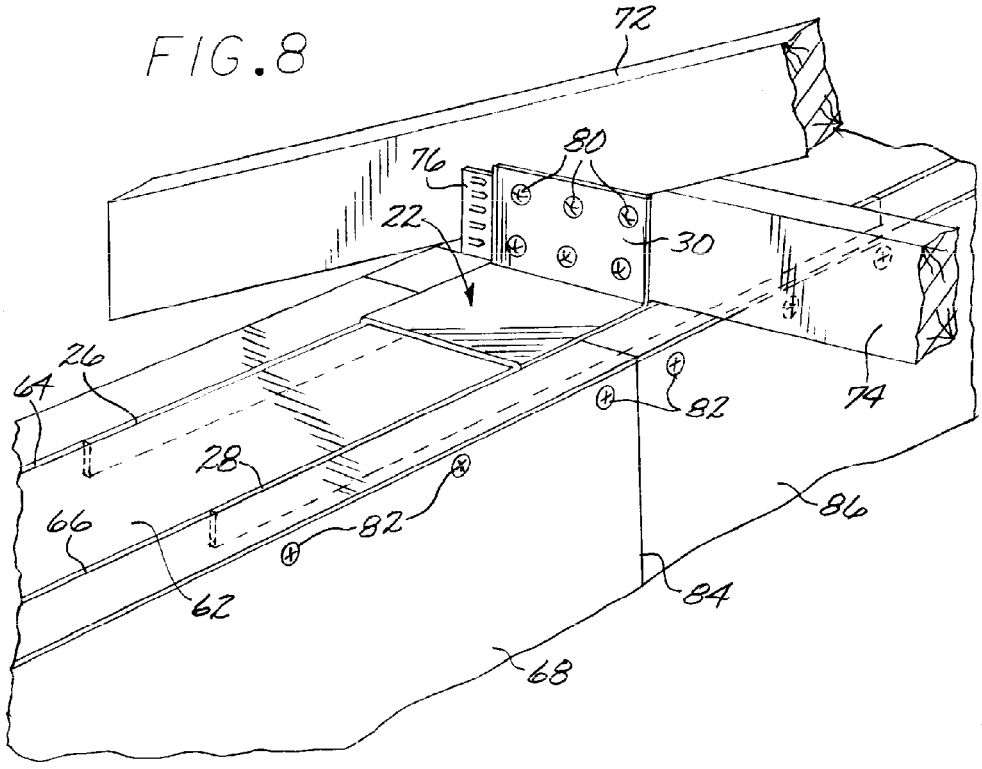
FIG. 8 is a perspective view similar to FIG. 5 illustrating the second embodiment of the truss bracket according to the present invention mounted in position in the top track of the wall system wherein the bracket extended mount tabs span two wall panels.

In FIG. 8, the second embodiment 22 of the truss bracket having extended left 26 and right 28 mounting tabs is illustrated in position within the top track 62 grooves 64 and 66 wherein the mounting tabs bridging the gap 84 between adjacent abutting panels 68 and 86 so as to provide additional structural integrity to the wall system. Fasteners 82 secure the top of the wall panels 68 and 86 to the top track 62 and the truss bracket 22. Similarly fasteners 80 secure the vertical receiving plate 30 to the roof truss bottom chord 74, gang plate 76 and top chord 72.

Figure 9:
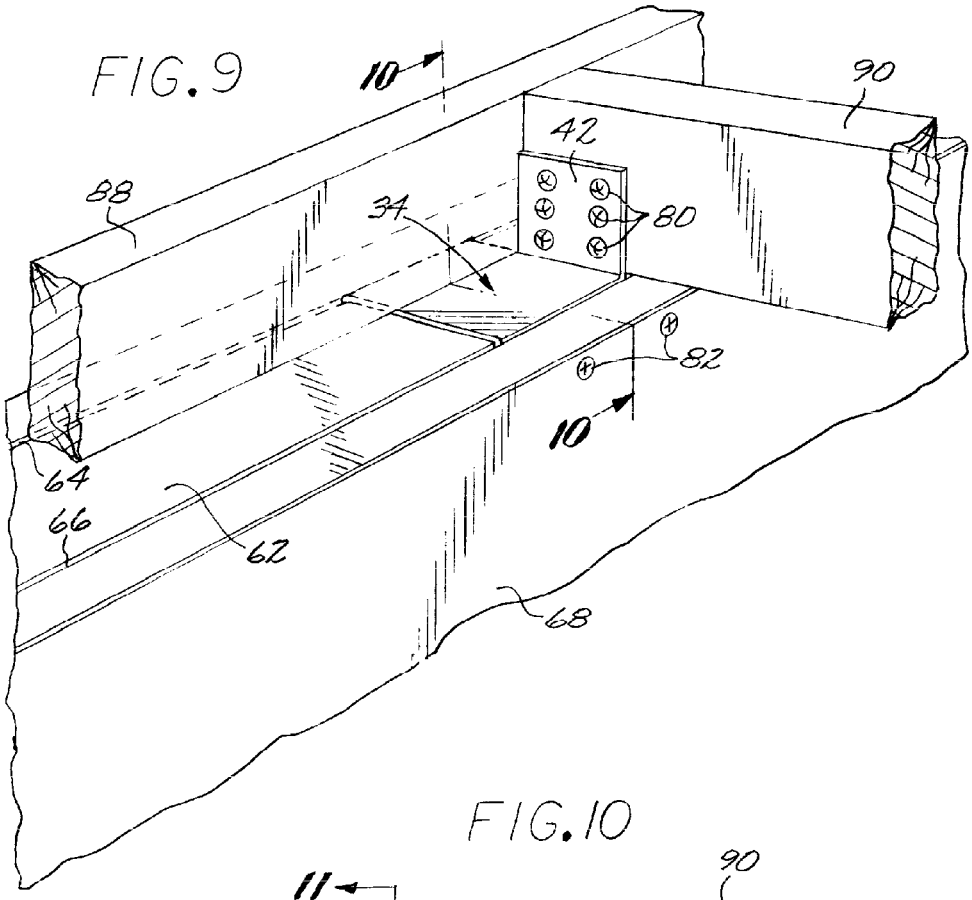
FIG. 9 is a perspective view showing the third embodiment of the truss bracket according to the present invention mounted in position in the top track of the wall system receiving a typical rim joist positioned within the joist relief of the truss bracket and a floor joist fixed to the vertical receiving plate.
Figure 10:
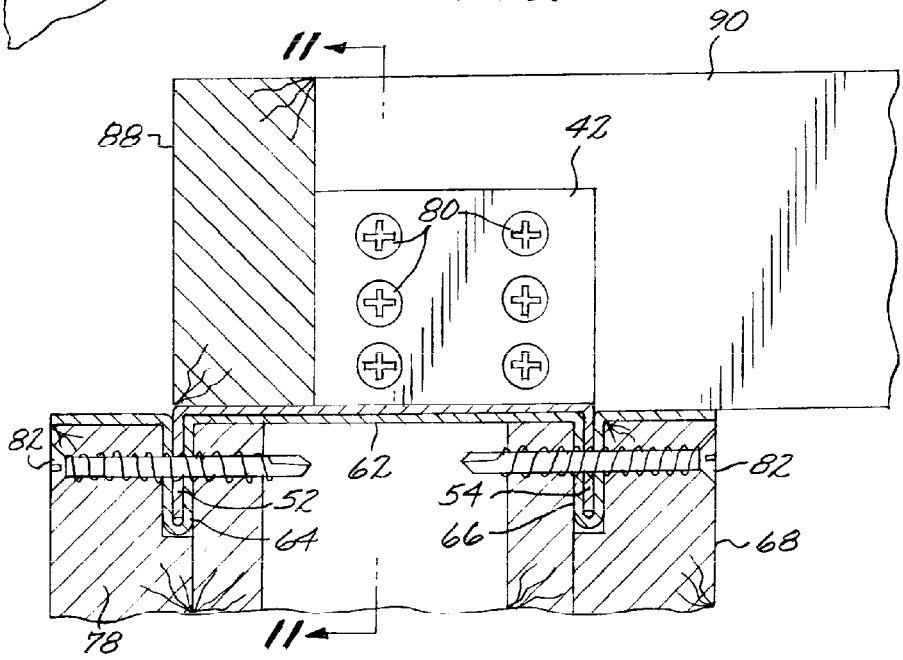
FIG. 10 is a cross section of the third embodiment truss bracket, rim and floor joist of FIG. 9 taken along Line 10-10 of FIG. 9 wherein the means of fastening the truss bracket to a typical floor joist and a wall system is detailed.
Figure 11:
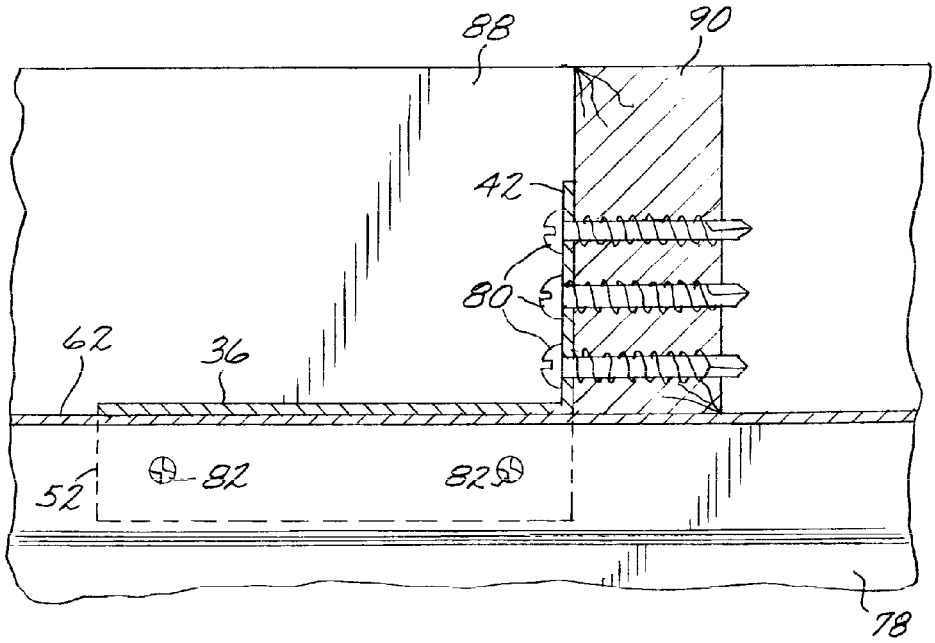
FIG. 11 is a cross section view taken on Line 11-11 of FIG. 10 showing the vertical receiving plate of the third embodiment of the truss bracket fastened to a typical floor joist.

Referring next to FIGS. 9, 10 and 11 illustrating a floor joist application utilizing the third embodiment of the truss bracket 34, a floor joist 90 is mounted perpendicular to a wall section and flush with the vertical receiving plate 42 by fasteners 80 penetrating the bores of the receiving plate 42 and into the floor joist 90. A typical rim joist 88 is illustrated in position mounted longitudinally along the wall section and in the joist relief of the truss bracket 34. The wall section utilizes the same top track 62 with longitudinal grooves 64 and 66 receiving the mounting tabs of the bracket 34 and secured by fasteners 82 to the wall panels 78 and 68.

In FIG. 10, the mounting of the truss bracket mounting tabs 52 and 54 to the top track 62 grooves 64 and 66 is the same as other embodiments. The placement of the rim joist 88 in the relief in the vertical receiving plate 42 provides clearance for the joist 88 on top of the wall section and positioning over load bearing panel 78.

As shown in FIG. 11, the means for fastening the floor joist 90 to the vertical receiving plate 42 in perpendicular disposition relative to rim joist 88. The base plate 36 flush with the top track 62 and mounting tab 52 within top track groove 62 in the left panel 78.

Figure 12:
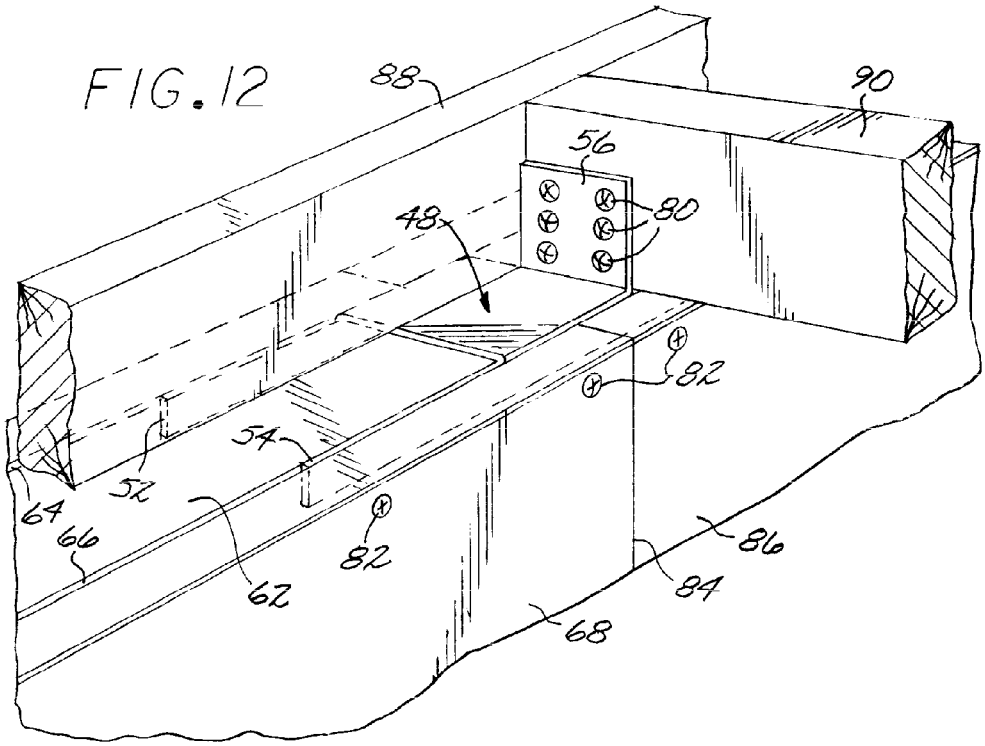
FIG. 12 is a perspective view similar to FIG. 9 illustrating the third embodiment of the truss bracket according to the present invention mounted in position in the top track of the wall system wherein the bracket extended mount tabs span two wall panels and fixed to a typical floor joist with a typical rim joist positioned with the recess of the vertical receiving plate.

FIG. 12 illustrates the fourth embodiment of the truss bracket 48 being similar to the third embodiment wherein the left 52 and right 54 mounting tabs are extended to the front and rear so as to accommodate bridging the gap 84 between adjacent panels 68 and 86 in rim joist 88 and floor joist 90 mounting applications. In a similar fashion, vertical receiving plate 56 is secured to the floor joist 80 and the truss bracket mounting tabs 52 and 54 are secured in the top track 62 left 64 and right 66 grooves by fasteners 82.

The truss bracket may be constructed of any suitable material; however, the truss bracket may be readily constructed of flat sheet metal cut appropriately so as to form the vertical receiving tab and mounting tabs by folding or bending the sheet metal along the left, rear and right edges of the base plate. This low cost manufacturing method avoids having to weld components while maintaining the integrity of plated surfaces and maximizing the strength of the edge connections.

I claim:

1. A truss mounting apparatus for a studless wall system, comprising;

a bracket having a base plate having a width, a length and rear, left and right edges, a left mounting tab being a plate having a top edge fixed to the left edge of the base plate and extending downwards from the base plate, a right mounting tab being a plate having a top edge fixed to the right edge of the base plate and extending downwards from the base plate, and a vertical receiving plate having a bottom edge fixed to the rear edge of the base plate and extending upwards from the base plate, a track being an elongate plate having a top and a bottom, the top having at least two longitudinally disposed grooves, each respectively receiving the right and left mounting tabs of the bracket, and forming downward facing ribs along the bottom of the track, at least two in-plane load bearing panels having a top edge, the top edge of each panel having a longitudinally disposed panel groove, each panel top edge groove respectively receiving a rib of the track; and, a structural component attached to the vertical receiving plate of the bracket.

2. The truss mounting apparatus of claim 1 wherein the vertical receiving plate of the bracket has a plurality of bores for receiving roof truss and floor joist fasteners.

3. The truss mounting apparatus of claim 1 further comprising a means for fastening the vertical receiving plate of the bracket to the structural component selected from the group consisting of roof trusses and floor joists.

4. The truss mounting apparatus of claim 1 wherein the bracket is constructed of sheet metal.

5. The truss mounting apparatus of claim 1 wherein the vertical receiving plate has a width equal to the width of the base plate.

6. The truss mounting apparatus of claim 1 wherein the vertical receiving plate further comprises a rim joist relief.

7. The truss mounting apparatus of claim 1 wherein the left and right mounting tabs of the bracket are each rectangular and have a longitudinal length greater than the length of the base plate such that the mounting tabs extend to the front and rear of the base plate.

8. The truss mounting apparatus of claim 1 further comprising a means for fastening the bracket mounting tabs, the track ribs, and the panels together.

9. The truss mounting apparatus of claim 8 wherein the means for fastening the bracket, the track ribs, and the panels together is selected from the group consisting of drill point screws, self-tapping screws, screws, brads, nails and bolts.

10. The truss mounting apparatus of claim 9 wherein the panel has a side surface and the means for fastening is a fastener disposed perpendicularly through the side surface of the panel, the track rib, and a mounting tab of the bracket.

11. The truss mounting apparatus of claim 1 wherein the track is constructed of sheet metal.

* * * * *